US012096842B1

(12) United States Patent
Yang

(10) Patent No.: US 12,096,842 B1
(45) Date of Patent: Sep. 24, 2024

(54) SPORTS WATER BOTTLE

(71) Applicant: NEARLOCK CO., LTD, Shenzhen (CN)

(72) Inventor: Bin Yang, Shenzhen (CN)

(73) Assignee: NEARLOCK CO., LTD, Shenzhen (CN)

( * ) Notice: Subject to any disclaimer, the term of this patent is extended or adjusted under 35 U.S.C. 154(b) by 0 days.

(21) Appl. No.: 18/424,735

(22) Filed: Jan. 26, 2024

(30) Foreign Application Priority Data

Jan. 15, 2024 (CN) ..... 202410054477.1

(51) Int. Cl.
*A45F 5/00* (2006.01)
*A45F 3/18* (2006.01)
*B65D 25/20* (2006.01)

(52) U.S. Cl.
CPC ..... *A45F 5/00* (2013.01); *A45F 3/18* (2013.01); *B65D 25/20* (2013.01); *A45F 2005/002* (2013.01); *A45F 2200/0516* (2013.01); *A45F 2200/055* (2013.01)

(58) Field of Classification Search
CPC .. A45F 5/00; A45F 3/18; B65D 25/20; B65D 25/205
See application file for complete search history.

(56) References Cited

U.S. PATENT DOCUMENTS 9,084,468 B2 * 7/2015 Conwell ..... A45F 5/00
10,155,482 B2 12/2018 Corso
10,576,905 B1 3/2020 MacNeil et al.
11,338,971 B1 5/2022 Capper et al.
11,492,175 B2 * 11/2022 Wang ..... B65D 23/12
11,753,209 B1 * 9/2023 Parry ..... B65D 23/14 215/395
2012/0187008 A1 * 7/2012 Gillingwater ..... B29C 49/54 206/232
2017/0129650 A1 * 5/2017 Karas ..... F16B 2/22
2017/0225833 A1 * 8/2017 Ni ..... A45F 3/18
2017/0245624 A1 * 8/2017 Neves ..... A45F 3/18
2018/0228280 A1 8/2018 Li et al.
2020/0047948 A1 * 2/2020 Zitron ..... B65D 25/04
2020/0085177 A1 * 3/2020 Walk ..... A45C 3/001
2020/0087044 A1 * 3/2020 Weiksnar ..... B65D 25/20
2021/0179321 A1 6/2021 Karbakhsh

* cited by examiner

*Primary Examiner* — Brian D Nash

(74) *Attorney, Agent, or Firm* — S.J. Intellectual Property LTD.

(57) ABSTRACT

Provided is a sports water bottle, including: a water bottle body and a plurality of functional accessories. A peripheral side of the water bottle body has a first outer wall and a second outer wall, and a first connecting piece or a second connecting piece is arranged on the first outer wall and/or the second outer wall. Each of the functional accessories is provided with the second connecting piece corresponding to the first connecting piece on the water bottle body; and/or each of the functional accessories is provided with the first connecting piece corresponding to the second connecting piece. The first connecting piece and the second connecting piece are matched with each other and detachably connected.

10 Claims, 12 Drawing Sheets

SPORTS WATER BOTTLE

CROSS-REFERENCE TO RELATED APPLICATIONS

The application claims priority to Chinese patent application No. 202410054477.1, filed on Jan. 15, 2024, the entire contents of which are incorporated herein by reference.

TECHNICAL FIELD

The present disclosure relates to the technical field of sports products and 3C digital products.

BACKGROUND

A healthy life cannot be separated from various sports. People often wear clothes convenient for exercise. Such clothes are inconvenient for carrying things such as mobile phones or change, resulting in inconvenience in the use of daily appliances such as mobile phones or change after exercise.

People usually need to replenish water during exercise, so they will carry a sports bottle to replenish water. For this phenomenon, manufacturers of sports products have introduced a change purse or a mobile phone bag with a nylon strap or a leather strap. These products can be bound around the water bottle through an adjustable strap, thereby storing mobile phones or changes and other articles.

However, the above products have corresponding defects that the strap binding the change purse or the mobile phone bag has poor adaptability to the body of the water bottle and is prone to fall off from the water bottle in the process of taking and placing articles, resulting in inconvenience of taking and placing articles and causing the articles to be lost. In addition, these storage products have poor product consistency with the water bottles, resulting in an overall unattractive water bottle. Therefore, it is urgent to propose a related product to at least overcome the defects in the existing products.

SUMMARY

An objective of the present disclosure is to provide a sports water bottle, so that sports water bottle products have the functions of a water bottle, and at least further have the functions of portably storing mobile phones, change, keys, ID cards and other cards.

To achieve the above objective, the present disclosure provides the following technical solution:

the present disclosure provides a sports water bottle, including: a water bottle body and a plurality of functional accessories; a peripheral side of the water bottle body at least has a first outer wall and a second outer wall, and a first connecting piece or a second connecting piece is arranged on the first outer wall and/or the second outer wall; the plurality of functional accessories at least include a mobile phone shell, a storage bag and a card holder; each of the functional accessories is provided with the second connecting piece corresponding to the first connecting piece on the water bottle body; and/or each of the functional accessories is provided with the first connecting piece corresponding to the second connecting piece on the water bottle body. The first connecting piece and the second connecting piece are matched with each other and detachably connected, so that each of the functional accessories is detachably connected to the first outer wall and/or the second outer wall.

Further, mounting grooves are respectively formed in the first outer wall and the second outer wall, and external dimensions of the mounting grooves are adapted to the first connecting piece and the second connecting piece, so that the first connecting piece and the second connecting piece can be embedded into the first outer wall and/or the second outer wall through the mounting grooves.

Further, the first outer wall and the second outer wall are arranged oppositely, and the first connecting piece and/or the second connecting piece are/is embedded into the first outer wall and/or the second outer wall through the mounting grooves.

Further, the first connecting piece and/or the second connecting piece on the water bottle body are/is connected to a ring strap, respectively; an annular groove adapted to the ring strap is formed in the peripheral side of the water bottle body; the annular groove communicates with the mounting grooves in the first outer wall and the second outer wall, respectively; the first connecting piece and/or the second connecting piece are embedded into the first outer wall and/or the second outer wall respectively through the mounting grooves; and the ring strap is fixed to the annular groove through a threaded connecting piece.

Further, the first connecting piece and/or the second connecting piece on the water bottle body include/includes a first magnet, the first connecting piece and/or the second connecting piece on each of the functional accessories comprise/comprises a second magnet, and the first magnet and the second magnet attract each other.

Further, a rotation limiting structure is arranged on the first connecting piece, the second connecting piece is provided with a first connecting groove and a ring groove which communicate with each other, the rotation limiting structure is matched with an external dimension of the first connecting groove and can be arranged in the ring groove through the first connecting groove, and the first connecting piece rotates relative to the second connecting piece through the rotation limiting structure and the ring groove; and when the first connecting piece rotates to a preset angle relative to the second connecting piece, the first connecting piece and the second connecting piece are fixed relatively.

Further, a clamping jaw structure is arranged on the first connecting piece, a first clamping groove matched with the clamping jaw structure is formed in the second connecting piece, and the first connecting piece can be clamped and fixed with the second connecting piece through the clamping jaw structure and the first clamping groove.

Further, a sliding limiting structure is arranged on the first connecting piece, the second connecting piece is provided with a second connecting groove and a sliding groove which communicate with each other, the sliding limiting structure is matched with an external dimension of the second connecting groove and is arranged in the sliding groove through the second connecting groove, and the first connecting piece can slide relative to the second connecting piece through the sliding limiting structure and the sliding groove; and when the first connecting piece slides to a preset distance relative to the second connecting piece in a preset direction, the first connecting piece and the second connecting piece are fixed relatively.

Further, the first connecting piece is provided with a protruding structure, the second connecting piece is provided with a clamping edge limiting structure and a sunken structure, the clamping edge limiting structure is matched with an external dimension of the second clamping groove, the first connecting piece can be connected to the second connecting piece through the protruding structure and the sunken structure, and the first connecting piece and the second connecting piece are fixed relatively through the clamping edge limiting structure and the second clamping groove.

Further, the plurality of functional accessories further include universal connecting buckles.

According to the analysis, the present disclosure discloses a sports water bottle; a first connecting piece and/or a second connecting piece are arranged on a first outer wall and/or a second outer wall of a peripheral side of a water bottle body of the sports water bottle; the sports water bottle has a plurality of functional accessories; each of the functional accessories is correspondingly provided with the second connecting piece or the first connecting piece corresponding to the first connecting piece and/or the second connecting piece on the water bottle body; and each of the functional accessories can be detachably connected to the water bottle body through the first connecting piece and the second connecting piece. For example, in a case that the water bottle body is provided with the first connecting piece, the functional accessories are correspondingly provided with the second connecting piece, so that the functional accessories can be detachably connected to the first connecting piece on the water bottle body. The functional accessories may achieve the functions of storing mobile phones, change, ID cards or IC cards, respectively. The sports water bottle disclosed by the present disclosure has the functions of the sports water bottle, and can achieve the function of portably storing mobile phones, change and daily articles. The water bottle body and the functional accessories of the sports water bottle have product consistency, the appearance is beautiful, and use is facilitated.

BRIEF DESCRIPTION OF DRAWINGS

The drawings of the specification that constitute a part of the present application are used to provide a further understanding of the present disclosure. The exemplary embodiments of the present disclosure and the description thereof are used to explain the present disclosure, and do not constitute an improper limitation of the present disclosure. In the drawings.

Figure 1:
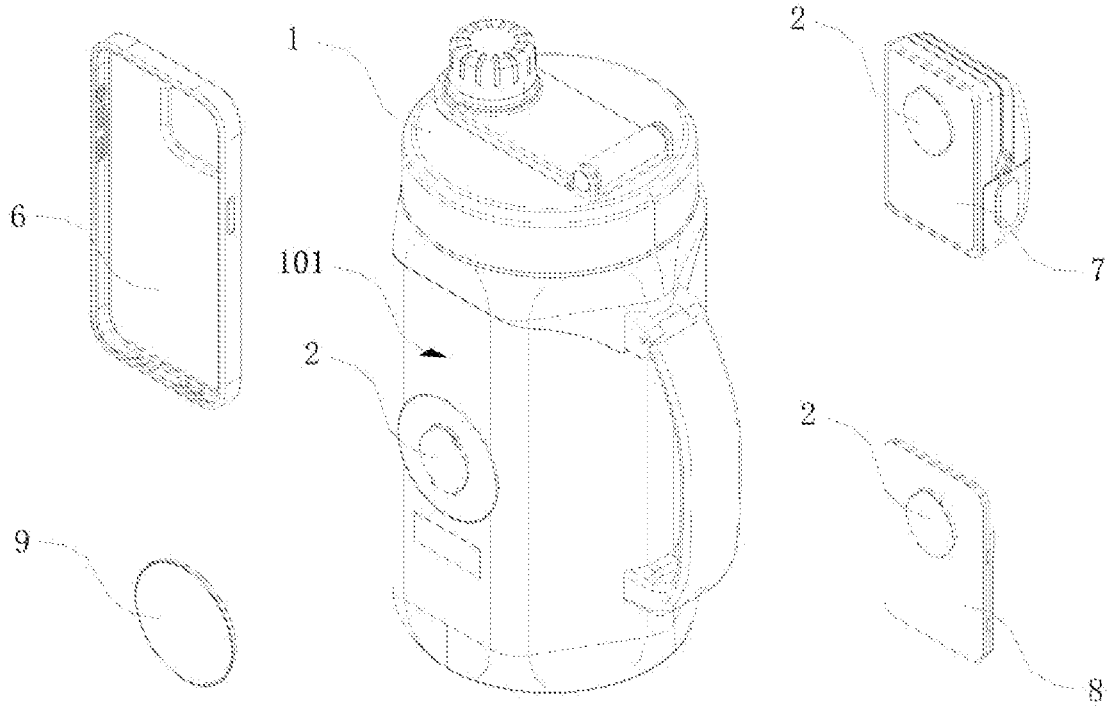
FIG. 1 is a schematic exploded view of an axis side structure of a first angle in a first implementation scheme of a sports water bottle according to an embodiment of the present disclosure.
Figure 2:
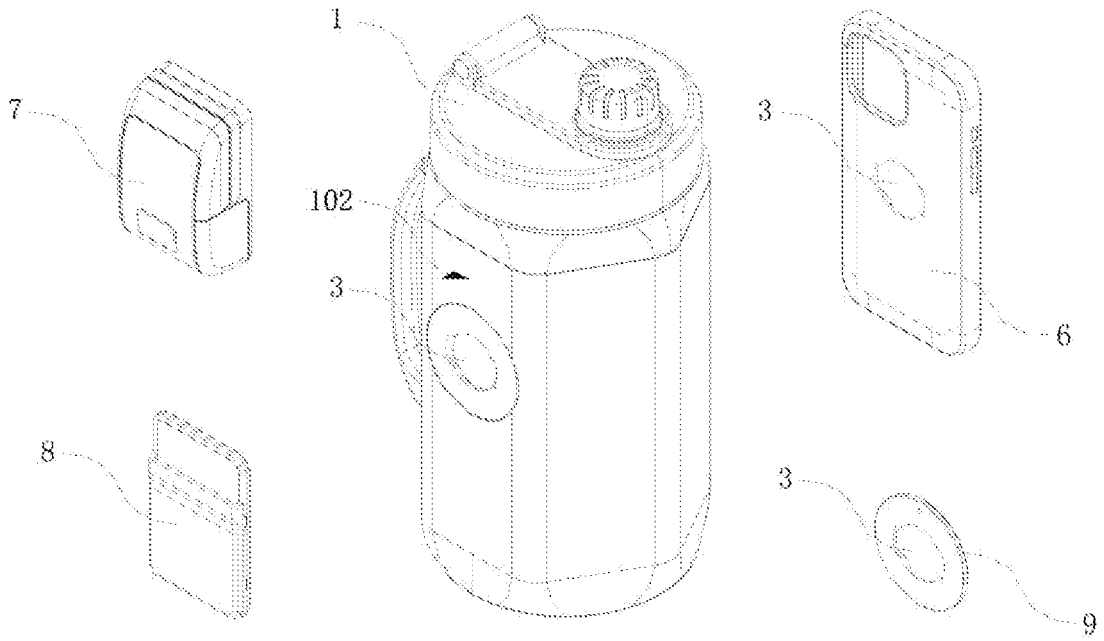
FIG. 2 is a schematic exploded view of an axis side structure of a second angle in a first implementation scheme of a sports water bottle according to an embodiment of the present disclosure.
Figure 3:
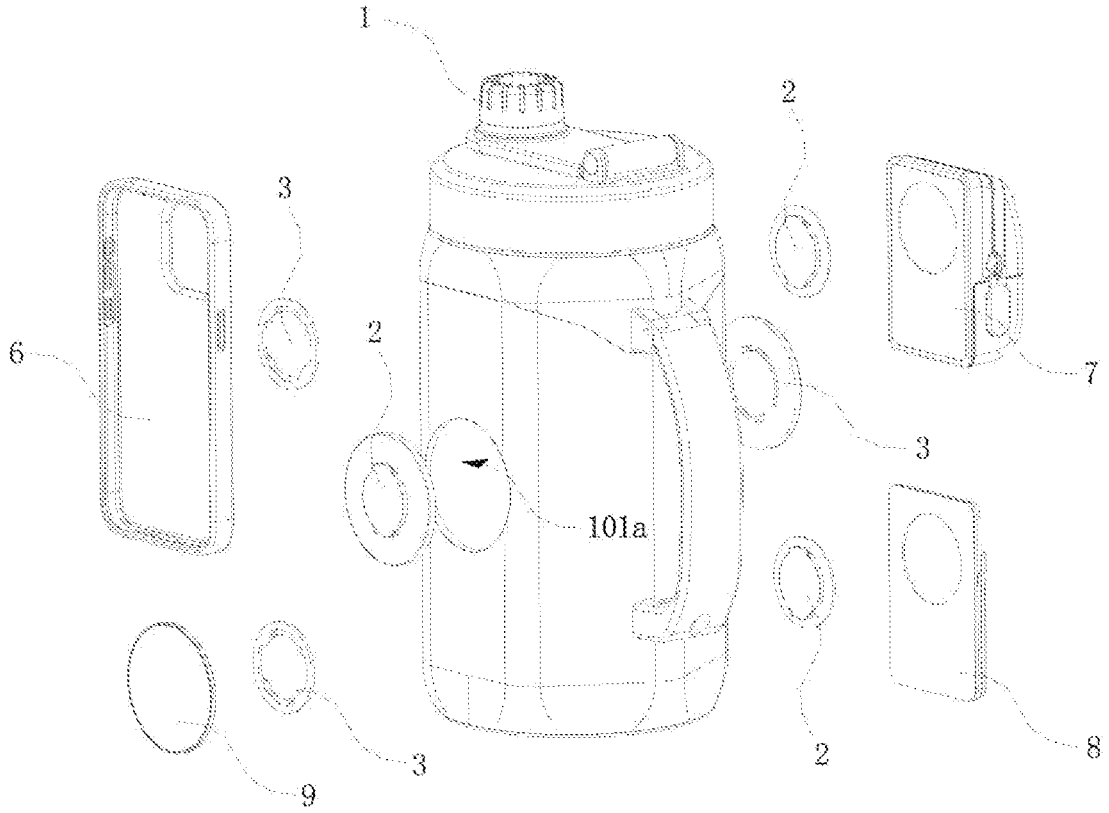
FIG. 3 is a schematic exploded view of an axis side structure of a first angle between a water bottle body and each functional accessory in a first implementation scheme of a sports water bottle according to an embodiment of the present disclosure.
Figure 4:
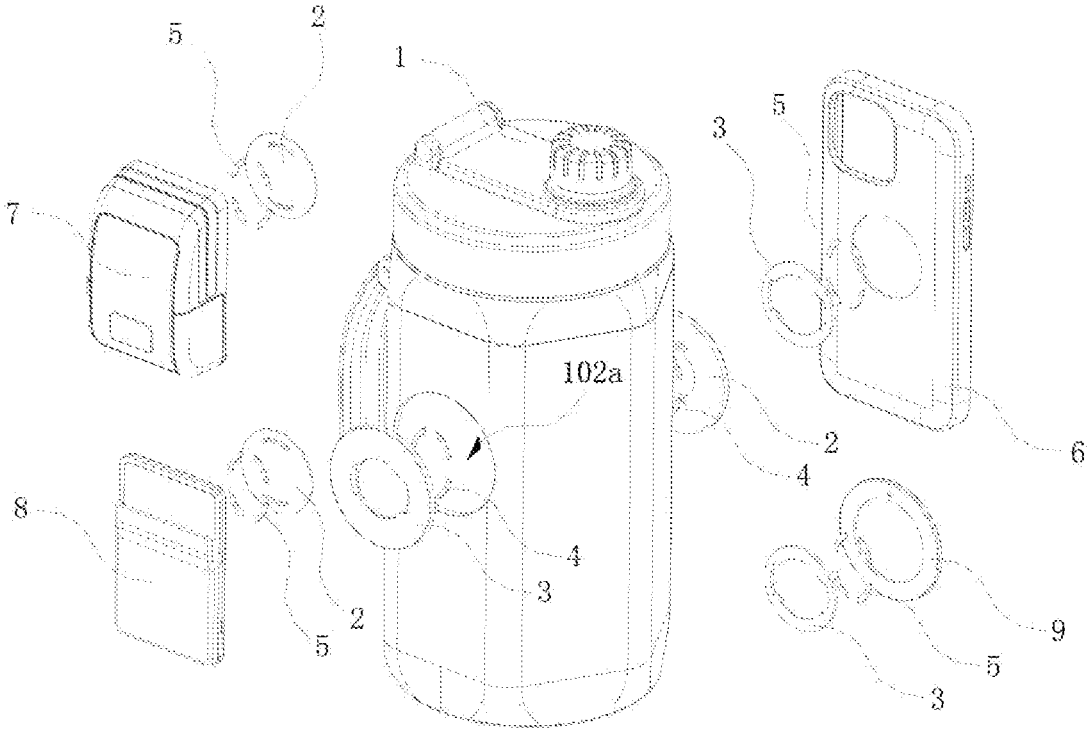
FIG. 4 is a schematic exploded view of an axis side structure of a second angle between a water bottle body and each functional accessory in a first implementation scheme of a sports water bottle according to an embodiment of the present disclosure.
Figure 5:
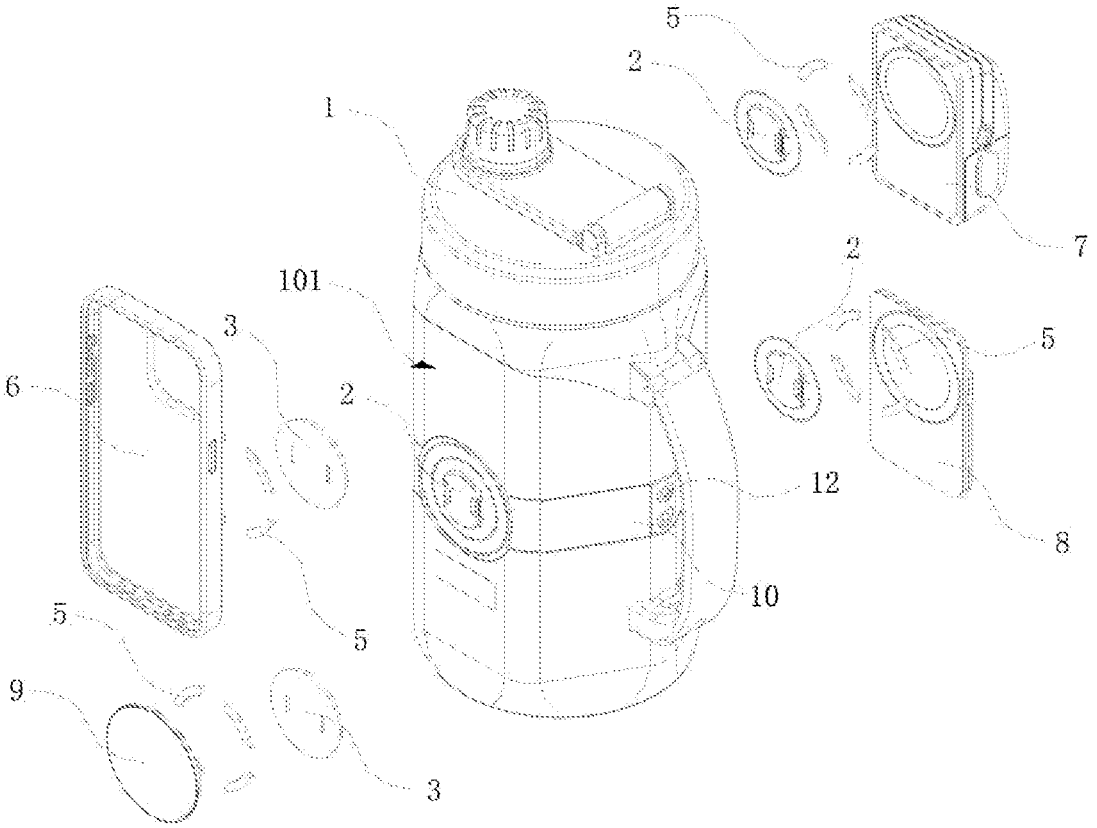
FIG. 5 is a schematic exploded view of an axis side structure of a first angle in a second implementation scheme of a sports water bottle according to an embodiment of the present disclosure.
Figure 6:
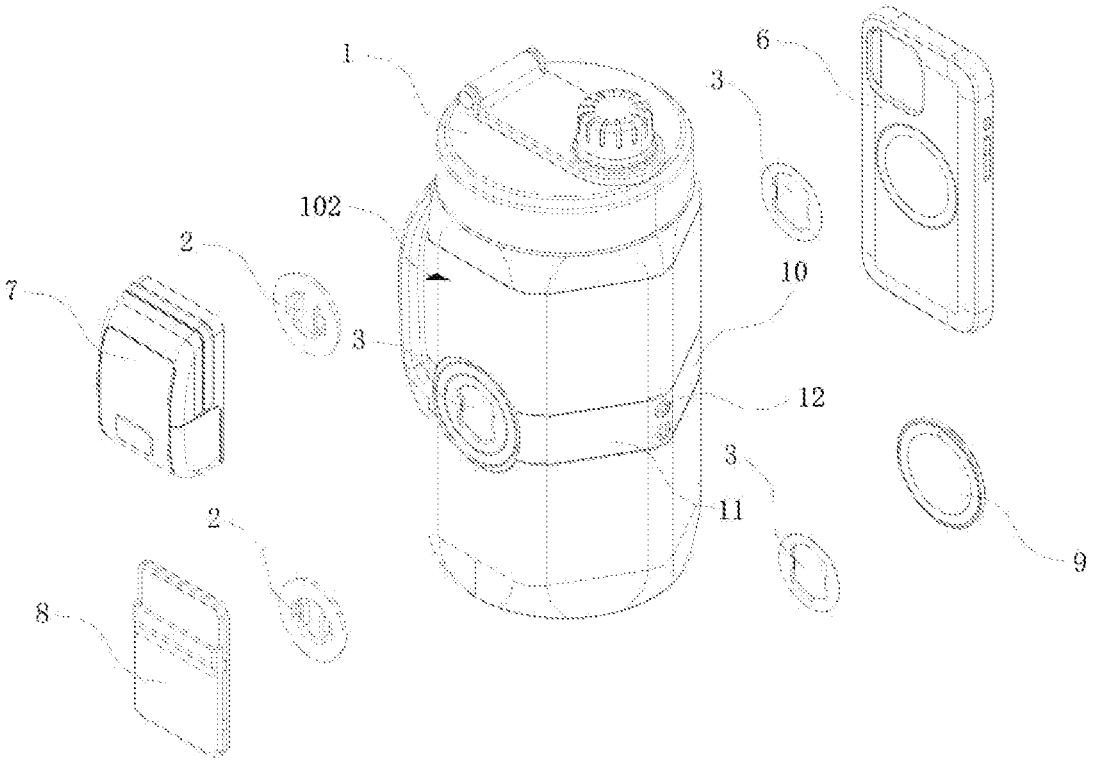
FIG. 6 is a schematic exploded view of an axis side structure of a second angle in a second implementation scheme of a sports water bottle according to an embodiment of the present disclosure.
Figure 7:
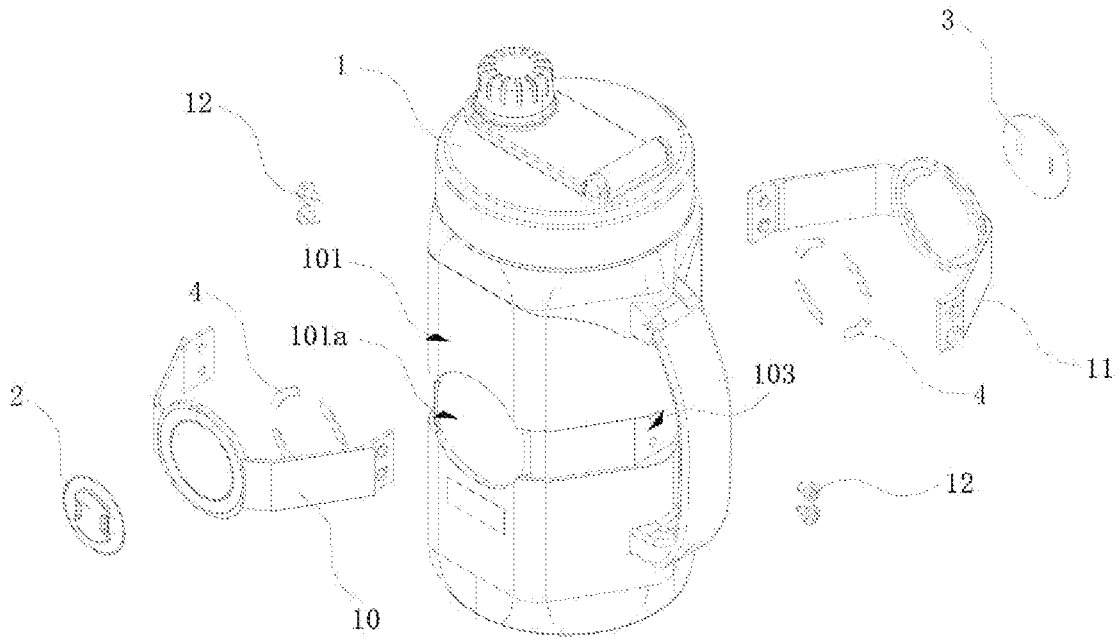
FIG. 7 is a schematic exploded view of an axis side structure of a first angle of a water bottle body in a second implementation scheme of a sports water bottle according to an embodiment of the present disclosure.
Figure 8:
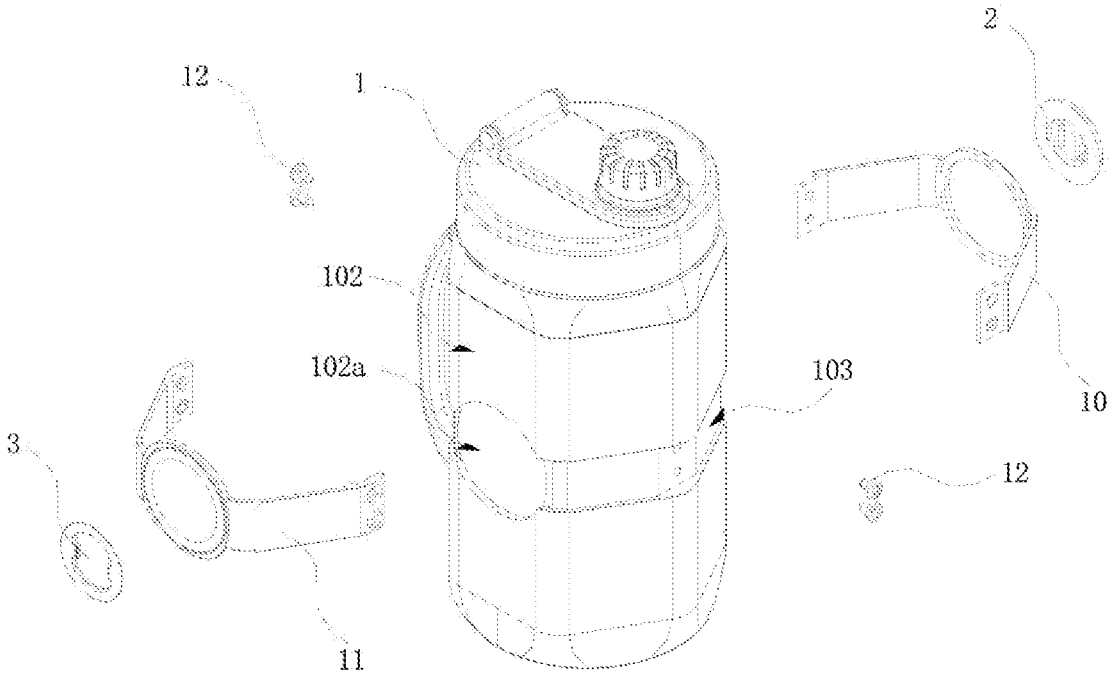
FIG. 8 is a schematic exploded view of an axis side structure of a second angle of a water bottle body in a second implementation scheme of a sports water bottle according to an embodiment of the present disclosure.

Description of reference numerals of the drawings: 1. water bottle body; 101. first outer wall; 101*a*. first mounting groove; 102. second outer wall; 102*a*. second mounting groove; 103. annular groove; 2. first connecting piece; 201. rotation limiting structure; 201*a*. first limiting groove; 202. clamping jaw structure; 203. sliding limiting structure; 203*a*. second limiting groove; 204. protruding structure; 204*a* second clamping groove; 3. second connecting piece; 301. first connecting groove; 302. ring groove; 302*a*. first limiting structure; 303. first clamping groove; 304. second connecting groove; 305. sliding groove; 305*a*. second limiting structure; 306. clamping edge limiting structure; 307. sunken structure, 4. first magnet; 5. second magnet; 6. mobile phone shell; 7. storage bag; 8. card holder; 9. universal connecting buckle; 10. first ring strap; 11. second ring strap; 12. screw.

DETAILED DESCRIPTION OF THE EMBODIMENTS

The present disclosure will be described in detail below with reference to the accompanying drawings and in conjunction with embodiments. Various examples are provided by way of interpretation of the present disclosure and are not intended to limit the present disclosure. Indeed, it will be apparent to those skilled in the art that modifications and variations may be made in the present disclosure without departing from the scope or spirit of the present disclosure. For example, features shown or described as part of one embodiment may be used in another embodiment to produce yet another embodiment. Therefore, it is desirable that the present disclosure includes such modifications and variations falling within the scope of the appended claims and their equivalents.

In the description of the present disclosure, the terms "longitudinal", "transverse", "up", "down", "front", "back", "left", "right", "vertical", "horizontal", "top", "bottom" and the like denote orientation or positional relationships based on those shown in the drawings and are intended for ease of description only and not to require that the present disclosure is necessarily constructed and operated in a particular orientation and thus cannot be construed as a limitation to the present disclosure. The terms "connection", "connect" and "set" used in the present disclosure should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present disclosure are shown in the accompanying drawings. The detailed description uses numeric and letter marks to refer to features in the drawings. Similar or like reference signs in the drawings and descriptions have been used to refer to similar or like parts of the present disclosure. As used herein, the terms "first", "second" and "third" and the like are used interchangeably to distinguish one member from another and are not intended to denote the location or importance of individual members.

As shown in FIG. 1 to FIG. 8, embodiments of the present disclosure provide a sports water bottle. The sports water bottle includes: a water bottle body 1 and a plurality of functional accessories; a peripheral side of the water bottle body 1 at least has a first outer wall 101 and a second outer wall 102, and a first connecting piece 2 or a second connecting piece 3 is arranged on the first outer wall 101 and/or the second outer wall 102; the plurality of functional accessories at least include a mobile phone shell 6, a storage bag 7 and a card holder 8; each of the functional accessories is provided with the second connecting piece 3 corresponding to the first connecting piece 2 on the water bottle body 1; and/or each of the functional accessories is provided with the first connecting piece 2 corresponding to the second connecting piece 3 on the water bottle body 1. The first connecting piece 2 and the second connecting piece 3 are matched with each other and detachably connected, so that each of the functional accessories is detachably connected to the first outer wall 101 and/or the second outer wall 102.

Preferably, the water bottle body 1 of the sports water bottle has a columnar structure with an axis extending in a longitudinal direction, an outer wall of a peripheral side of the water bottle body has a first outer wall 101 and a second outer wall 102, and the first outer wall 101 and the second outer wall 102 are arranged oppositely.

Optionally, the first connecting pieces 2 are arranged on the first outer wall 101 and/or the second outer wall 102, respectively; and each of the functional accessories is provided with the second connecting piece 3.

Optionally, the second connecting pieces 3 are arranged on the first outer wall 101 and/or the second outer wall 102, respectively; and each of the functional accessories is provided with the first connecting piece 2.

Preferably, the first connecting piece 2 is arranged on the first outer wall 101; the second connecting piece 3 is arranged on the second outer wall 102; and in the plurality of functional accessories, each of the functional accessories is provided with the second connecting piece 3 corresponding to the first connecting piece 2 on the first outer wall 101, or each of the functional accessories is provided with the first connecting piece 2 corresponding to the second connecting piece 3 on the second outer wall 102.

Specifically, as shown in FIG. 1 to FIG. 6, the plurality of functional accessories include but are not limited to a mobile phone shell 6, a storage bag 7, a card holder 8 and a universal connecting buckle 9. The first connecting piece 2 is arranged on the first outer wall 101 of the water bottle body 1, and the second connecting piece 3 is arranged on the second outer wall 102 of the water bottle body 1. The second connecting pieces 3 are respectively arranged on the mobile phone shell 6 and the universal connecting buckle 9, so that the mobile phone 6 and the universal connecting buckle 9 can be detachably connected to the first outer wall 101 of the water bottle body 1. The first connecting pieces 2 are respectively arranged on the storage bag 7 and the card holder 8, so that the storage bag 7 and the card holder 8 can be detachably connected to the second outer wall 102 of the water bottle body 1.

Optionally, the plurality of functional accessories can select any one or two of the functional accessories to be used with the water bottle body 1 according to the use requirements of users. The mobile phone shell 6 can be configured to place a mobile phone; the storage bag 7 is configured to store change, keys, IC cards, portable tablets or other daily articles; the card holder 8 can be configured to singly insert ID cards or IC cards; the card holder 8 has a function similar to that of the storage bag 7 and has a corresponding storage function, but the structure of the card holder 8 is smaller and more compact, and a user can select the storage bag 7 or the card holder 8 according to the number and types of the articles to be stored; and the universal connecting buckle 9 can be configured to directly connect a mobile phone with a specification and a model incompatible with the mobile phone shell 6 to the peripheral side of the water bottle body 1 through gluing or magnetic attraction so as to be used with mobile phone products with more specifications and models in the market.

Optionally, in the functional accessories, the first connecting pieces 2 may be arranged on the mobile phone shell 6 and the universal connecting buckle 9; the second connecting pieces 3 may be arranged on the storage bag 7 and the card holder 8; and when not using the water bottle body 1, a user can detachably connect the storage bag 7 or the card holder 8 to the mobile phone shell 6 and the universal connecting buckle 9 directly, so that the user can portably store daily articles through the storage bag 7 or the card holder 8 when using a mobile phone daily.

Optionally, as shown in FIG. 1 to FIG. 8, a first mounting groove 101*a* is formed in the first outer wall 101 of the water bottle body 1, a second mounting groove 102*a* is formed in the second outer wall 102 of the water bottle body 1, the first connecting piece 2 on the water bottle body 1 is embedded in the first mounting groove 101*a* through a structural adhesive or ultrasonic welding, and the second connecting piece 3 on the water bottle body 1 is embedded into the second mounting groove 102*a* through the structural adhesive or ultrasonic welding. In the plurality of functional accessories, the first connecting piece 2 or the second connecting piece 3 may be fixed on the corresponding functional accessory through the structural adhesive or ultrasonic welding.

Optionally, as shown in FIG. 5 to FIG. 8, an annular groove 103 is formed in the outer wall of the peripheral side of the water bottle body 1, the annular groove 103 communicates with the first mounting groove 101*a* in the first outer wall 101 and the second mounting groove 102*a* in the second outer wall 102, the first connecting piece 2 mounted in the first mounting groove 101*a* is connected to a first ring strap 10, the second connecting piece 3 mounted in the second mounting groove 102*a* is provided with a second ring strap 11, the first ring strap 10 and the second ring strap 11 respectively have a semi-ring-shaped structure, and width dimensions of the first ring strap and the second ring strap are respectively adapted to a groove width dimension of the annular groove 103. The first connecting piece 2 on the water bottle body 1 is located in the middle of the first ring strap 10, the second connecting piece 3 on the water bottle body 1 is located in the middle of the second ring strap 11, two ends of the first ring strap 10 are respectively in overlapping connection with two ends of the second ring strap 11, and two ends of the first ring strap 10 and two ends of the second ring strap 11 are mounted in the annular groove 103 through screws 12.

Optionally, as shown in FIG. 4, FIG. 5, FIG. 7 and FIG. 8, the first connecting piece 2 and the second connecting piece 3 respectively have a sheet-like structure; first magnets 4 are respectively arranged on one side of the first connecting piece 2 on the water bottle body 1 close to the first mounting groove 101*a* and on one side of the second connecting piece 3 close to the second mounting groove 102*a*; a second magnet 5 corresponding to the first magnet 4 of the water bottle body 1 is arranged on one side of the first connecting piece 2 or the second connecting piece 3 on each of the functional accessories close to the functional accessories; and the first magnet 4 and the second magnet 5 can attract each other, so that each of the functional accessories can be located at the first connecting piece 2 or the second connecting piece 3 of the water bottle body 1 accurately in advance through the magnetic attraction between the first magnet 4 and the second magnet 5, thereby ensuring that the water bottle body 1 can be connected to each of the functional accessories accurately through the corresponding connecting structure, and facilitating the detachable connection between each of the functional accessories and the water bottle body 1. A plurality of first magnets 4 may be correspondingly arranged at the first mounting groove 101*a* and/or the second mounting groove 102*a*, the plurality of first magnets 4 arranged at each mounting groove may correspondingly adsorb a plurality of second magnets 5, and the plurality of first magnets 4 arranged at each mounting groove may be arranged in a circular array.

Optionally, the first connecting piece 2 and the second connecting piece 3 are detachably connected through a rotating structure.

Figure 9:
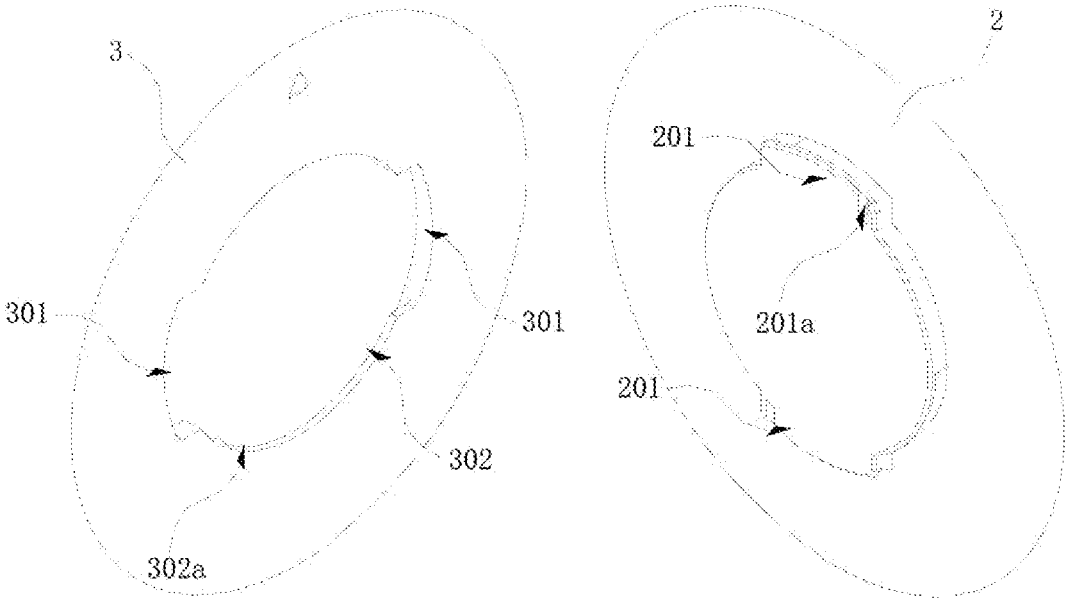
FIG. 9 is a schematic diagram of a first specific implementation structure of a first connecting piece and a second connecting piece in a sports water bottle according to an embodiment of the present disclosure.

Specifically, as shown in FIG. 9, the first connecting piece 2 has two rotation limiting structures 201 protruding outwards, and a first limiting groove 201*a* is respectively formed between the two rotation limiting structures 201 and a connecting surface of the first connecting piece 2; and the second connecting piece 3 has a first connecting groove 301 sunken inwards, and a ring groove 302 is formed between the first connecting groove 301 and a connecting surface of the second connecting piece 3. The two rotation limiting structures 201 of the first connecting piece 2 may be arranged in the ring groove 302 of the second connecting piece 3 through the first connecting groove 301, so that when the first connecting piece 2 rotates to a preset angle relative to the second connecting piece 3, the two rotation limiting structures 201 on the first connecting piece 2 can limit a relative position between the first connecting piece 2 and the second connecting piece 3. The two rotation limiting structures 201 are respectively provided with a first limiting groove 201*a*; two first limiting structures 302*a* are respectively arranged in the ring groove 302 corresponding to the two first limiting grooves 201*a*; and when the first connecting piece 2 and the second connecting piece 3 rotate to a preset angle, the two limiting structures 302*a* in the ring groove 302 are respectively arranged in the corresponding first limiting groove 201*a*, so that the first connecting piece 2 and the second connecting piece 3 can be connected and fixed. In a case that the first connecting piece 2 and the second connecting piece 3 on the water bottle body 1 are provided with the first magnets 4, and the first connecting piece 2 or the third connecting piece 3 on each of the functional accessories is correspondingly provided with the second magnet 5, the first magnets 4 and the second magnets 5 can ensure the accurate alignment of the two rotation limiting structures 201 in the first connecting piece 2 and the first connecting groove 301 in the second connecting piece 3, so that a user can rotate the first connecting piece 2 or the second connecting piece 3 conveniently, and the functional accessories and the water bottle body 1 can be connected and fixed.

Optionally, the first connecting piece 2 and the second connecting piece 3 are detachably connected through a clamping jaw clamping groove.

Figure 10:
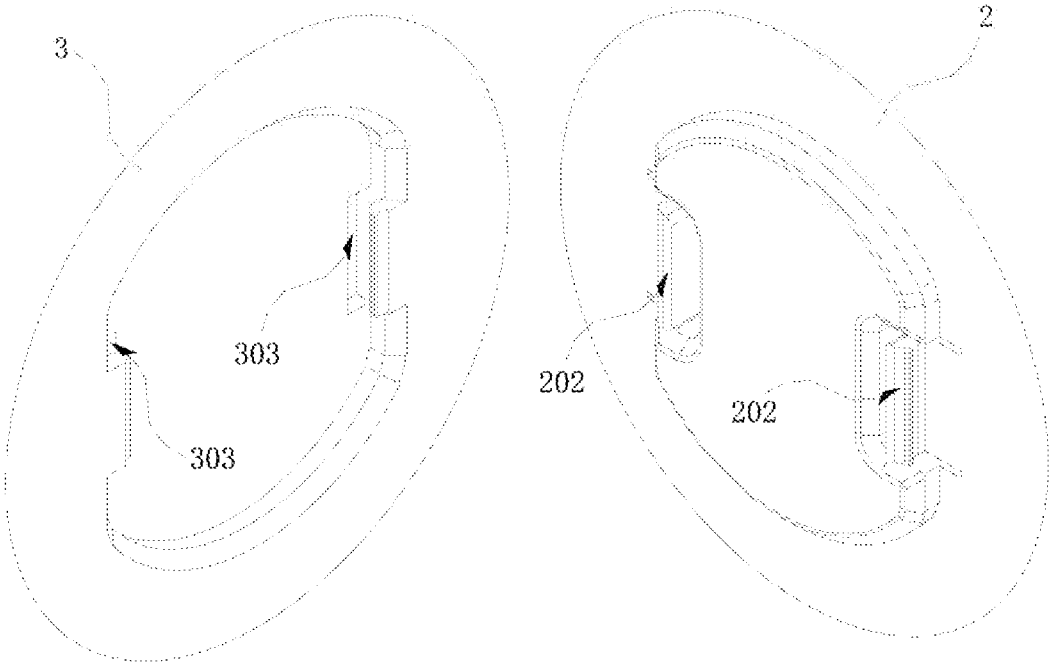
FIG. 10 is a schematic diagram of a second specific implementation structure of a first connecting piece and a second connecting piece in a sports water bottle according to an embodiment of the present disclosure.

Specifically, as shown in FIG. 10, two clamping jaw structures 202 are arranged on the first connecting piece 2 in a mirror image manner, two first clamping grooves 303 corresponding to the two clamping jaw structures 202 of the first connecting piece 2 are correspondingly arranged on the second connecting piece 3, and the first connecting piece 2 can be in clamping connection with the second connecting piece 3 corresponding to the two first clamping grooves 303 through the two clamping jaw structures 202. In a case that the first connecting piece 2 and the second connecting piece 3 on the water bottle body 1 are provided with the first magnets 4, and the first connecting piece 2 or the third connecting piece 3 on each of the functional accessories is correspondingly provided with the second magnet 5, the first magnets 4 and the second magnet 5 can ensure the accurate alignment between the functional accessories and the water bottle body 1, thereby achieving the automatic clamping connection between the functional accessories and the water bottle body 1.

Optionally, the first connecting piece 2 and the second connecting piece 3 are detachably connected through a sliding structure.

Figure 11:
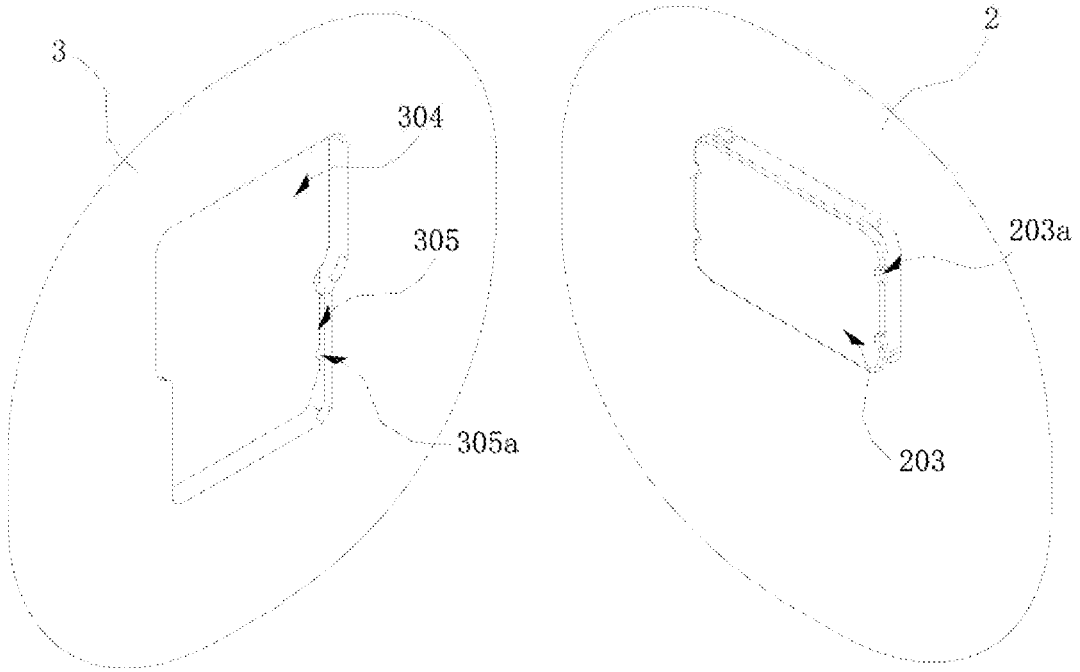
FIG. 11 is a schematic diagram of a third specific implementation structure of a first connecting piece and a second connecting piece in a sports water bottle according to an embodiment of the present disclosure.

Specifically, as shown in FIG. 11, the first connecting piece 2 is provided with a sliding limiting structure 203 protruding outwards, the second connecting piece 3 is provided with a second connecting groove 304 and a sliding groove 305 which are sunken inwards and communicate with each other, the second connecting groove 304 is adapted to an external dimension of the sliding limiting structure 203, the sliding groove 305 is matched with an external dimension of the sliding limiting structure 203, and the sliding limiting structure 203 can enter the sliding groove 305 through the second connecting groove 304 and slide downwards in the sliding groove 305 in a longitudinal direction. A second limiting groove 203*a* is formed in a side part of the sliding limiting structure 203; a second limiting structure 305*a* is arranged in the sliding groove 305 corresponding to the second limiting groove 203*a*; and after first connecting piece 2 slides to a preset distance relative to the second connecting piece 3 in the longitudinal direction, the second limiting structure 305*a* in the sliding groove 305 of the second connecting piece 3 is correspondingly arranged in the second limiting groove 203*a* of the sliding limiting structure 203 of the first connecting piece 2, so that the first connecting piece 2 and the second connecting piece 3 can be connected and fixed. In a case that the first connecting piece 2 and the second connecting piece 3 on the water bottle body 1 are provided with the first magnets 4, and the first connecting piece 2 or the third connecting piece 3 on each of the functional accessories is correspondingly provided with the second magnet 5, the first magnets 4 and the second magnets 5 can ensure that the sliding limiting structure 203 in the first connecting piece 2 can be accurately aligned with the second connecting groove 304 in the second connecting piece 3, so that a user can slidingly connect the first connecting piece 2 with the second connecting piece 3 conveniently, and the functional accessories and the water bottle body 1 can be connected and fixed.

Optionally, the first connecting piece 2 and the second connecting piece 3 are detachably connected through an insertion structure.

Figure 12:
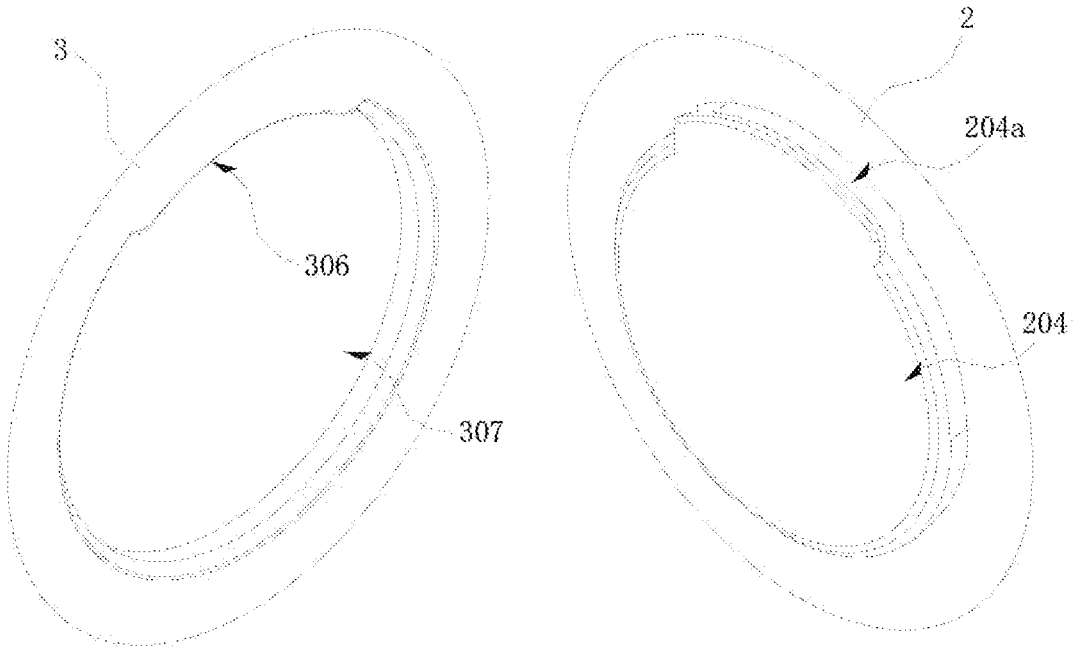
FIG. 12 is a schematic diagram of a fourth specific implementation structure of a first connecting piece and a second connecting piece in a sports water bottle according to an embodiment of the present disclosure.

Specifically, as shown in FIG. 12, the first connecting piece 2 is provided with a protruding structure 204 protruding outwards, a second clamping groove 204*a* is formed between the protruding structure 204 and the connecting surface of the first connecting piece 2, the second connecting piece 3 is provided with a sunken structure 307 which is sunken inwards and matched with an external dimension of the protruding structure 204, a clamping edge limiting structure 306 is arranged at an edge of the sunken structure 307, the protruding structure 204 of the first connecting piece 2 may be arranged in the sunken structure 307 of the second connecting piece 3, and the clamping edge limiting structure 306 of the second connecting piece 3 can be inserted into the second clamping groove 204*a* of the first connecting piece 2, so that the first connecting piece 2 and the second connecting piece 3 can be connected and fixed. In a case that the first connecting piece 2 and the second connecting piece 3 on the water bottle body 1 are provided with the first magnets 4, and the first connecting piece 2 or the second connecting piece 3 on each of the functional accessories is correspondingly provided with the second magnet 5, the connection strength between the first connecting piece 2 and the second connecting piece 3 can be enhanced through the magnetic attraction effect generated between the first magnets 4 and the second magnets 5, thereby avoiding the falling phenomenon between the functional accessories and the water bottle body 1.

From the above description, it can be seen that the above embodiment of the present disclosure achieves the following technical effects:

compared with the prior art, in the present disclosure, the first connecting piece 2 and the second connecting piece 3 are arranged on the opposite first outer wall 101 and second outer wall 102 on the water bottle body 1, the sports water bottle has the plurality of functional accessories, each of the functional accessories is correspondingly provided with the second connecting piece 3 or the first connecting piece 2 corresponding to the first connecting piece 2 or the second connecting piece 3 on the water bottle body 1, and each of the functional accessories can be detachably connected to the water bottle body 1 through the first connecting piece 2 and the second connecting piece 3. The functional accessories may achieve the functions of storing mobile phones, change, ID cards or IC cards, respectively. The sports water bottle disclosed by the present disclosure has the function of the water bottle, and can achieve the function of portably storing mobile phones, change or other daily articles. A user can select the corresponding functional accessories to be used with the water bottle body 1 according to the use requirements.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. A sports water bottle, comprising:

a water bottle body, a peripheral side thereof at least having a first outer wall and a second outer wall, and a first connecting piece or a second connecting piece being arranged on the first outer wall and/or the second outer wall; and a plurality of functional accessories, at least comprising a mobile phone shell, a storage bag and a card holder, each of the functional accessories being provided with the second connecting piece corresponding to the first connecting piece on the water bottle body, and/or each of the functional accessories being provided with the first connecting piece corresponding to the second connecting piece on the water bottle body, wherein the first connecting piece and the second connecting piece are matched with each other and detachably connected, so that each of the functional accessories is detachably connected to the first outer wall and/or the second outer wall.

2. The sports water bottle according to claim 1, wherein mounting grooves are respectively formed in the first outer wall and the second outer wall, and external dimensions of the mounting grooves are adapted to the first connecting piece and the second connecting piece, so that the first connecting piece and the second connecting piece are embedded into the first outer wall and/or the second outer wall through the mounting grooves.

3. The sports water bottle according to claim 2, wherein the first outer wall and the second outer wall are arranged oppositely, and the first connecting piece and/or the second connecting piece are/is embedded into the first outer wall and/or the second outer wall through the mounting grooves.

4. The sports water bottle according to claim 3, the first connecting piece and/or the second connecting piece on the water bottle body are/is connected to a ring strap, respectively; an annular groove adapted to the ring strap is formed in the peripheral side of the water bottle body; the annular groove communicates with the mounting grooves in the first outer wall and the second outer wall, respectively; the first connecting piece and/or the second connecting piece are embedded into the first outer wall and/or the second outer wall respectively through the mounting grooves; and the ring strap is fixed to the annular groove through a threaded connecting piece.

5. The sports water bottle according to claim 3, wherein the first connecting piece and/or the second connecting piece on the water bottle body comprise/comprises a first magnet, the first connecting piece and/or the second connecting piece on each of the functional accessories comprise/comprises a second magnet, and the first magnet and the second magnet attract each other.

6. The sports water bottle according to claim 3, wherein a rotation limiting structure is arranged on the first connecting piece, the second connecting piece is provided with a first connecting groove and a ring groove which communicate with each other, the rotation limiting structure is matched with an external dimension of the first connecting groove and is arranged in the ring groove through the first connecting groove, and the first connecting piece rotates relative to the second connecting piece through the rotation limiting structure and the ring groove; and when the first connecting piece rotates to a preset angle relative to the second connecting piece, the first connecting piece and the second connecting piece are fixed relatively.

7. The sports water bottle according to claim 3, wherein a clamping jaw structure is arranged on the first connecting piece, a first clamping groove matched with the clamping jaw structure is formed in the second connecting piece, and the first connecting piece is clamped and fixed with the second connecting piece through the clamping jaw structure and the first clamping groove.

8. The sports water bottle according to claim 3, wherein a sliding limiting structure is arranged on the first connecting piece, the second connecting piece is provided with a second connecting groove and a sliding groove which communicate with each other, the sliding limiting structure is matched with an external dimension of the second connecting groove and is arranged in the sliding groove through the second connecting groove, and the first connecting piece slides relative to the second connecting piece through the sliding limiting structure and the sliding groove; and when the first connecting piece slides to a preset distance relative to the second connecting piece in a preset direction, the first connecting piece and the second connecting piece are fixed relatively.

9. The sports water bottle according to claim 3, wherein the first connecting piece is provided with a protruding structure and a second clamping groove, the second connecting piece is provided with a clamping edge limiting structure and a sunken structure, the clamping edge limiting structure is matched with an external dimension of the second clamping groove, the first connecting piece is connected to the second connecting piece through the protruding structure and the sunken structure, and the first connecting piece and the second connecting piece are fixed relatively through the clamping edge limiting structure and the second clamping groove.

10. The sports water bottle according to claim 1, wherein the plurality of functional accessories further comprise universal connecting buckles.

* * * * *